US010878766B2

(12) United States Patent
Ohn et al.

(10) Patent No.: US 10,878,766 B2
(45) Date of Patent: Dec. 29, 2020

(54) LIQUID CRYSTAL DISPLAY DEVICE AND METHOD OF DRIVING THE SAME

(71) Applicant: SAMSUNG DISPLAY CO., LTD., Yongin-si (KR)

(72) Inventors: Wonjong Ohn, Jeonju-si (KR); Youngjin Kim, Yongin-si (KR); Taekyoung Kim, Gwangmyeong-si (KR); Joonbum Lee, Seoul (KR); Jaemin Ha, Asan-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 329 days.

(21) Appl. No.: 15/665,876

(22) Filed: Aug. 1, 2017

(65) Prior Publication Data

US 2018/0040288 A1 Feb. 8, 2018

(30) Foreign Application Priority Data

Aug. 2, 2016 (KR) ..... 10-2016-0098336

(51) Int. Cl.
*G09G 3/36* (2006.01)

(52) U.S. Cl.
CPC ..... *G09G 3/3688* (2013.01); *G09G 3/3677* (2013.01); *G09G 2310/0289* (2013.01);
(Continued)

(58) Field of Classification Search
CPC ..... G09G 3/3688; G09G 3/3677; G09G 2360/16; G09G 2320/0219;
(Continued)

(56) References Cited

U.S. PATENT DOCUMENTS

2003/0231146 A1* 12/2003 Lee ..... G09G 3/2007 345/60
2012/0182280 A1* 7/2012 Park ..... G09G 3/3648 345/211

(Continued)

FOREIGN PATENT DOCUMENTS

KR 10-2005-0006431 1/2005
KR 10-2007-0120279 12/2007
KR 10-2015-0120589 10/2015

*Primary Examiner* — Brent D Castiaux
(74) *Attorney, Agent, or Firm* — F. Chau & Associates, LLC

(57) ABSTRACT

An LCD device and a method of driving the LCD device that reduce scattering afterimages, the LCD device including: a liquid crystal display panel including a gate line, a data line intersecting the gate line and a pixel connected to the gate line and the data line; a timing controller receiving a data signal including a plurality of frames and outputting a data signal; a power supply generating a gamma reference voltage corresponding to the data signal; and a data driver receiving the data signal, receiving the gamma reference voltage corresponding to the data signal from the power supply and applying a data voltage to the data line. The timing controller includes: an analyzer comparing the data signal with an afterimage reference pattern; a determinator determining an afterimage vulnerable data signal of the data signal; and a control signal output circuit outputting a gamma reference voltage control signal increasing and decreasing a gamma reference voltage by a variable data voltage on a frame-by-frame basis in accordance with the afterimage vulnerable data signal. The power supply includes a gamma reference voltage adjuster receiving the gamma reference voltage control signal to adjust the gamma reference voltage.

19 Claims, 8 Drawing Sheets

(52) U.S. Cl.
CPC . *G09G 2310/08* (2013.01); *G09G 2320/0219* (2013.01); *G09G 2320/0257* (2013.01); *G09G 2320/0673* (2013.01); *G09G 2360/16* (2013.01)

(58) Field of Classification Search
CPC ... G09G 2320/0673; G09G 2320/0257; G09G 2310/0289; G09G 2310/08
See application file for complete search history.

(56) References Cited

U.S. PATENT DOCUMENTS

2015/0071550 A1* 3/2015 Jang ..... G06K 9/6212 382/199
2016/0035260 A1 2/2016 Kim et al.

* cited by examiner

LIQUID CRYSTAL DISPLAY DEVICE AND METHOD OF DRIVING THE SAME

CROSS-REFERENCE TO RELATED APPLICATION

This application claims priority under 35 U.S.C. § 119 from Korean Patent Application No. 10-2016-0098336, filed on Aug. 2, 2016, in the Korean Intellectual Property Office (KIPO), the disclosure of which is incorporated by reference herein.

1. Technical Field

Embodiments of the present inventive concept relate to a liquid crystal display ("LCD") device and a method of driving the LCD device.

2. Discussion of Related Art

LCD devices are one of the most widely used flat panel display (FPD) devices, which include two substrates on which electrodes are formed and a liquid crystal layer interposed therebetween. LCD devices adjust an amount of transmitted light by applying voltage to two electrodes to rearrange liquid crystal molecules in the liquid crystal layer.

When manufacturing an LCD panel, which includes two substrates and a liquid crystal layer interposed therebetween, each LCD panel has different residual DC values due to scattering of the process. Different residual DC values of the respective LCD panels generate different degrees of an afterimage that can be seen. Accordingly, the display quality of the LCD device may be degraded.

It is to be understood that this background of the technology section is intended to provide useful background for understanding the technology and as such disclosed herein, the technology background section may include ideas, concepts or recognitions that were not part of what was known or appreciated by those skilled in the pertinent art prior to a corresponding effective filing date of subject matter disclosed herein.

SUMMARY

Embodiments of the present disclosure may be directed to an LCD device capable of substantially preventing afterimage that may occur, for example due to a manufacturing process of an LCD panel, and may be directed to a method of driving the LCD device.

According to an embodiment of the inventive concept, a liquid crystal display device may include: a liquid crystal display panel including a gate line, a data line intersecting the gate line and a pixel connected to the gate line and the data line; a timing controller receiving a data signal including a plurality of frames and outputting a data signal; a power supply generating a gamma reference voltage corresponding to the data signal; and a data driver receiving the data signal, receiving the gamma reference voltage corresponding to the data signal from the power supply and applying a data voltage to the data line. The timing controller includes: an analyzer comparing the data signal with an afterimage reference pattern; a determinator determining an afterimage vulnerable data signal of the data signal; and a control signal output circuit configured to output a gamma reference voltage control signal increasing and decreasing a gamma reference voltage by a variable data voltage on a frame-by-frame basis in accordance with the afterimage vulnerable data signal. The power supply includes a gamma reference voltage adjuster receiving the gamma reference voltage control signal to adjust the gamma reference voltage.

The control signal output circuit may not output the gamma reference voltage control signal at an N-th (N being a natural number) frame.

The control signal output circuit may output a gamma reference voltage control signal for increasing a gamma reference voltage corresponding to the afterimage vulnerable data signal at an (N+1)-th (N being a natural number) frame.

The control signal output circuit may output a gamma reference voltage control signal for decreasing a gamma reference voltage corresponding to the afterimage vulnerable data signal at an (N+2)-th (N being a natural number) frame.

The variable data voltage may be less than a gamma reference voltage difference of about a gray level 1.

The afterimage reference pattern may have a white color and a black color.

The liquid crystal display device may further include a storage unit storing the afterimage reference pattern.

According to an embodiment of the inventive concept, a method of driving a liquid crystal display device includes comparing a data signal including a plurality of frames with an afterimage reference pattern; determining an afterimage vulnerable data signal of the data signal; outputting a gamma reference voltage control signal corresponding to the afterimage vulnerable data signal; adjusting the gamma reference voltage in accordance with the gamma reference voltage control signal; and generating a data voltage based on the adjusted gamma reference voltage.

The outputting of a signal for adjusting the gamma reference voltage corresponding to the afterimage vulnerable data signal may include not outputting the gamma reference voltage control signal corresponding to the afterimage vulnerable data at an N-th (N being a natural number) frame.

The outputting of a signal for adjusting the gamma reference voltage corresponding to the afterimage vulnerable data signal may include outputting a gamma reference voltage control signal for increasing the gamma reference voltage corresponding to the afterimage vulnerable data at an (N+1)-th (N being a natural number) frame.

The outputting of a signal for adjusting the gamma reference voltage corresponding to the afterimage vulnerable data signal may include outputting a gamma reference voltage control signal for decreasing the gamma reference voltage corresponding to the afterimage vulnerable data at an (N+2)-th (N being a natural number) frame.

The adjusting of the gamma reference voltage in accordance with the gamma reference voltage control signal may include increasing or decreasing the gamma reference voltage by a variable data voltage less than a gamma reference voltage difference of about a gray level 1.

The afterimage reference pattern may have a white color and a black color.

The comparing of the data signal including a plurality of frames with the afterimage reference pattern may include retrieving an afterimage reference pattern.

The foregoing is illustrative only and is not limiting of the appended claims. In addition to the illustrative aspects, embodiments and features described above, further aspects, embodiments and features will be better appreciated by a person of ordinary skill in the art by reference to the drawings and the following detailed description.

According to an embodiment of the inventive concept, a liquid crystal device, includes: a liquid crystal display panel comprising a plurality of gate lines, a plurality of data lines intersecting the gate line and a plurality of pixels, each connected to one of the plurality of gate lines and one of the plurality of data lines; a timing controller configured to receive a data signal comprising a plurality of frames and output a data signal, and configured to determine an afterimage-vulnerable data signal of the data signal based on a correspondence of the data signal with at least one afterimage reference pattern; a power supply configured to generate a gamma reference voltage corresponding to the data signal; a data driver configured to receive the data signal from the timing controller, receive the gamma reference voltage corresponding to the data signal from the power supply, and apply a data voltage to the data line; a gate driver configured to generate gate signals according to a gate control signal (GCS) provided from the timing controller and sequentially applies the gate signals to the plurality of gate lines. A positive data voltage Vdata (+) and a negative data voltage Vdata (−) are sequentially applied to the plurality of data lines, and a pixel voltage is applied to the plurality of pixels connected to the data lines, and wherein a liquid crystal layer is charged by a voltage difference between the pixel voltage and a common voltage, and the voltage difference is adjusted in response to detection of a correspondence of the data signal with an afterimage reference pattern on a frame-by-frame basis.

The liquid crystal device includes a memory that may store a plurality of afterimage reference patterns including the at least one afterimage reference pattern.

The timing controller receives from a graphic controller a data signal, a horizontal synch (Hsync) signal, a vertical synch (Vsync) signal, a clock (DCLK) signal.

The afterimage-vulnerable data signal of the data signal that represents the afterimage reference pattern is determined and a gamma reference voltage control signal increases or decreases the gamma reference voltage on a frame-by-frame basis in accordance with the afterimage-vulnerable data signal being output.

In an embodiment of the inventive concept, a non-transitory computer readable medium comprising instructions that, when executed by a processor, performs a method of driving a liquid crystal display device, the method including: comparing a data signal comprising a plurality of frames with an afterimage reference pattern; determining an afterimage-vulnerable data signal of the data signal based on the comparing with the afterimage reference pattern; outputting a gamma reference voltage control signal corresponding to the afterimage-vulnerable data signal; adjusting the gamma reference voltage in accordance with the gamma reference voltage control signal; and generating a data voltage based on the adjusted gamma reference voltage.

BRIEF DESCRIPTION OF THE DRAWINGS

A more complete appreciation of the present inventive concept will become more apparent by describing in detail embodiments of the inventive concept thereof with reference to the accompanying drawings, wherein.

DETAILED DESCRIPTION

Figure 1:
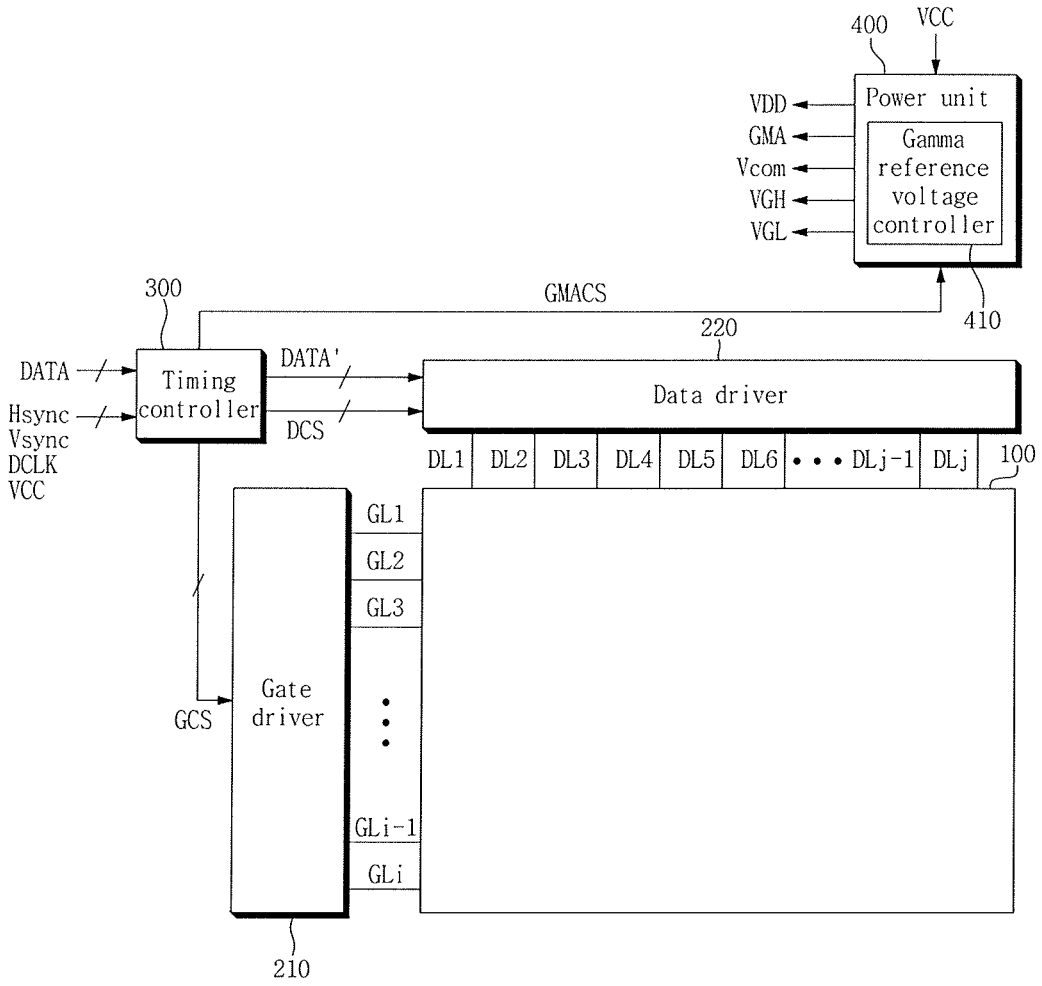
FIG. 1 is a block diagram illustrating an LCD device according to an embodiment of the inventive concept.

Exemplary embodiments will now be described more fully hereinafter with reference to the accompanying drawings. Although the inventive concept may be modified in various manners and have several embodiments, some embodiments are illustrated in the accompanying drawings and will be described in the specification. However, the scope of the inventive concept is not limited to the embodiments shown and described herein, and should be construed as including all the changes, equivalents and substitutions included in the spirit and scope of the inventive concept.

In the drawings, the thicknesses of a plurality of layers and areas are illustrated in an enlarged manner for clarity and explanatory purposes. When a layer, area, or plate is referred to as being "on" another layer, area, or plate, a person of ordinary skill in the art should understand and appreciate that the layer, area of plate may be directly on the other layer, area, or plate, or intervening layers, areas, or other layers, areas, or plates may be present therebetween. Conversely, when a layer, area, or plate is referred to as being "directly on" another layer, area, or plate, intervening layers, areas, or plates may be absent therebetween. Further when a layer, area, or plate is referred to as being "below" another layer, area, or plate, it may be directly below the other layer, area, or plate, or intervening layers, areas, or plates may be present therebetween. Conversely, when a layer, area, or plate is referred to as being "directly below" another layer, area, or plate, intervening layers, areas, or plates may be absent therebetween.

The spatially relative terms "below", "beneath", "less", "above", "upper" and the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device positioned "below" or "beneath" another device may be placed "above" another device. Accordingly, the illustrative term "below" may include both the lower and upper positions. The device may also be oriented in the other direction and thus the spatially relative terms may be interpreted differently depending on the orientations.

Throughout the specification, when an element is referred to as being "connected" to another element, the element is "directly connected" to the other element, or "electrically connected" to the other element with one or more intervening elements interposed therebetween. A person of ordinary skill in the art should understand that the terms "comprises," "comprising," "includes" and/or "including," when used in this specification, specify the presence of stated features, integers, steps, operations, elements and/or components, but do not preclude the presence or addition of one or more other features, integers, steps, operations, elements, components and/or groups thereof.

In addition, although the terms "first," "second," "third," and the like may be used herein to describe various elements, these elements are not to be limited by these terms. In other words, these terms are used to distinguish one element from another element. Thus, "a first element" discussed below could be termed "a second element" or "a third element," and "a second element" and "a third element" may be termed likewise without departing from the teachings herein.

"About" or "approximately", as used herein, is inclusive of the stated value and may be defined as being within an acceptable range of deviation for the particular value as determined by one of ordinary skill in the art, considering the measurement in question and the error associated with measurement of the particular quantity (i.e., the limitations of the measurement system). For example, "about" may be defined as being within one or more standard deviations, or within ±30%, 20%, 10%, 5% of the stated value.

Unless otherwise defined, all terms used herein (including technical and scientific terms) have the same meaning as commonly understood by a person of ordinary skill in the art to which this inventive concept pertains. It will be further understood by a person of ordinary skill that terms, such as those defined in commonly used dictionaries, should be interpreted as having a meaning that is consistent with their meaning in the context of the relevant art and will not be interpreted in an ideal or excessively formal sense unless clearly defined as such in the present specification.

Well-known configurations and constructions may not be provided herein so as not to obscure the inventive concept with such well-known configurations and constructions. In the description of the present inventive concept, like reference numerals refer to like elements throughout the specification.

Hereinafter, an LCD device according to an embodiment of the inventive concept will now be described in detail with reference to FIGS. 1 to 6C.

Figure 2:
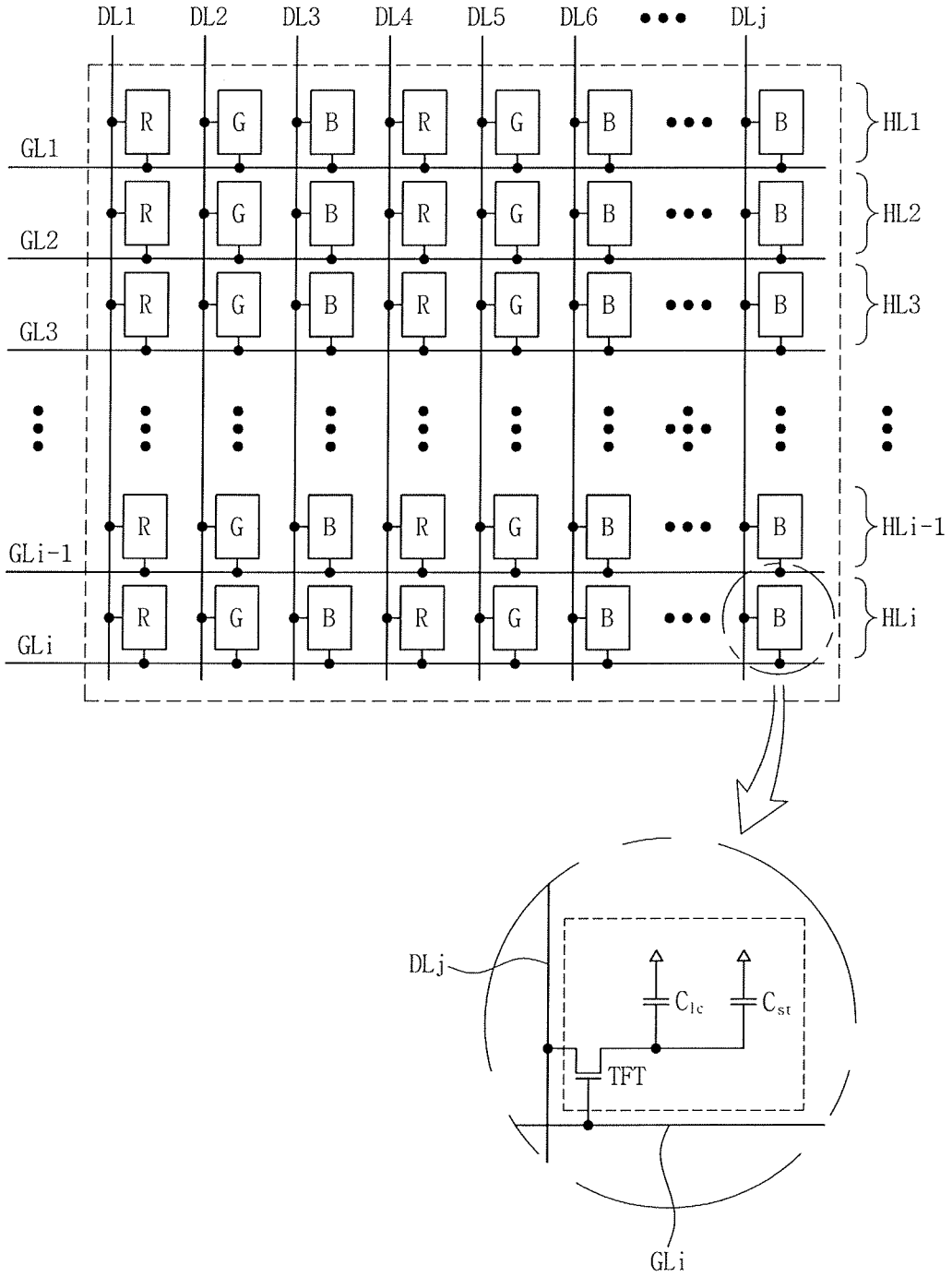
FIG. 2 is a mimetic view schematically illustrating pixels included in a display panel.
Figure 3:
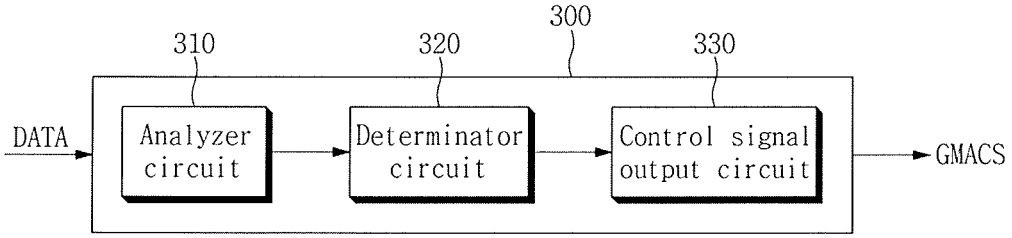
FIG. 3 is a block diagram illustrating a timing controller.

FIG. 1 is a block diagram illustrating an LCD device according to an embodiment of the inventive concept, FIG. 2 is a mimetic view schematically illustrating pixels included in a display panel, and FIG. 3 is a block diagram illustrating a timing controller.

Referring to FIGS. 1, 2 and 3, an LCD device according to an embodiment of the inventive concept will be described in detail.

As illustrated in FIG. 1, the LCD device may include a display panel 100, a gate driver 210, a data driver 220, a timing controller 300 and a power unit 400.

The display panel 100 displays an image. In this embodiment, the display panel 100 includes a liquid crystal layer (not illustrated), a first substrate (not illustrated) and a second substrate (not illustrated) facing each other with the liquid crystal layer interposed therebetween.

As illustrated in FIG. 2, the display panel 100 may include a plurality of gate lines GL1 to GLi, a plurality of data lines DL1 to DLj and a plurality of pixels R, G and B. The plurality of pixels may be arranged in an alternating arrangement of Rs, Gs and Bs.

The gate lines GL1 to GLi are insulated from the intersecting data lines DL1 to DLj.

As shown in FIG. 2, the pixels R, G and B are arranged along horizontal lines HL1 to HLi. The pixels R, G and B are connected to the gate lines GL1 to GLi and the data lines DL1 to DLj. For example, there are "j" number of pixels arranged along an n-th (n being one selected from 1 to i) horizontal line (hereinafter, n-th horizontal line pixels), which are connected to the first to j-th data lines DL1 to DLj, respectively. Furthermore, the n-th horizontal line pixels are connected in common to the n-th gate line. Accordingly, the n-th horizontal line pixels receive an n-th gate signal as a common signal. For example, "j" number of pixels disposed in a same horizontal line receive a same gate signal, while pixels disposed in different horizontal lines receive different gate signals, respectively. For example, pixels in a first horizontal line HL1 receive a first gate signal as a common signal, while pixels in a second horizontal line HL2 receive a second gate signal that has a different timing from that of the first gate signal.

As illustrated in the enlarged portion of FIG. 2, each of the pixels R, G and B includes a thin film transistor ("TFT"), a liquid crystal capacitor Clc and a storage capacitor Cst.

The TFT is turned on according to a gate signal applied from the gate line GLi. The turned-on TFT applies an analog data signal applied from the data line DL1 to the liquid crystal capacitor Clc and the storage capacitor Cst.

The liquid crystal capacitor Clc includes a pixel electrode (not illustrated) and a common electrode (not illustrated) which oppose each other.

The storage capacitor Cst includes a pixel electrode (not illustrated) and an opposing electrode (not illustrated) which oppose each other. Herein, the opposing electrode may be, for example, a previous gate line GLi−1 or a transmission line for transmitting a common voltage.

With reference to FIG. 1, the timing controller 300 receives a vertical synchronization signal Vsync, a horizontal synchronization signal Hsync, a data signal DATA and a clock signal DCLK output from a graphic controller provided in a system. An interface circuit (not illustrated) is provided between the timing controller 300 and the system, and the above signals output from the system are input to the timing controller 300 through the interface circuit. The interface circuit may be embedded in the timing controller 300.

Although not illustrated, the interface circuit may include a low voltage differential signaling (LVDS) receiver. The interface circuit lowers the voltage levels of the vertical synchronization signal Vsync, the horizontal synchronization signal Hsync, the data signal DATA and the clock signal DCLK output from the system, while raising the frequencies thereof.

In an embodiment of the inventive concept, there may be electromagnetic interference (EMI) that occurs due to high frequency components of a signal input from the interface circuit to the timing controller 300. To prevent the EMI, an EMI filter (not illustrated) may be further provided between the interface circuit and the timing controller 300.

With continued reference to FIG. 1, the timing controller 300 generates a gate control signal GCS for controlling the gate driver 210 and a data control signal DCS for controlling the data driver 220, using the vertical synchronization signal Vsync, the horizontal synchronization signal Hsync and the clock signal DCLK. The gate control signal GCS includes a gate start pulse, a gate shift clock, a gate output enable signal, and the like. The data control signal DCS includes a source start pulse, a source shift clock, a source output enable signal, a polarity signal, and the like.

In addition, the timing controller 300 rearranges the image data signals DATA input through the system and applies the rearranged image data signals DATA' to the data driver 220.

In an embodiment of the inventive concept, the timing controller 300 is driven by a driving power (VCC) output from a power unit 400 provided in the system. For example, the driving power VCC is used as a power voltage of a phase lock loop ("PLL") circuit embedded in the timing controller 300. The PLL circuit compares the clock signal DCLK input to the timing controller 300 with a reference frequency generated from an oscillator. Then, in the case where it is identified from the comparison that there is a difference between them, the PPL circuit adjusts the frequency of the clock signal DCLK by the difference to generate a sampling clock signal. This sampling clock signal is a signal for sampling the image data signals DATA'.

As illustrated in FIG. 3, the timing controller 300 according to an embodiment of the inventive concept compares the input data signal DATA with an afterimage reference pattern to determine an afterimage vulnerable data signal of the data signal, and outputs a gamma reference voltage control signal GMACS corresponding to the afterimage vulnerable data signal. There may be a plurality of afterimage patterns based on different images. To this end, the timing controller 300 comprises circuitry including an analyzer circuit 310, a determinator circuit 320, and a control signal output circuit 330.

In operation, the analyzer circuit 310 compares the data signal DATA input to the timing controller 300 with the afterimage reference pattern.

The afterimage reference pattern includes a pattern that when displayed is vulnerable to afterimage. For example, a pattern of white and black may be vulnerable to afterimage, and the viewer can easily detect an afterimage due to the difference between the two colors.

In addition, a person of ordinary skill in the art should appreciate that the after image may be a positive afterimage, in which the colors of the original image are maintained, or a negative afterimage, where the colors are inverted. In addition, the afterimage reference pattern is not limited to black and white. For example, the pattern may be red and green, or blue and yellow.

Although not illustrated, the timing controller 300 may further include a storage unit for storing the afterimage reference pattern.

With continued reference to FIG. 3, the determinator circuit 320 determines a data signal of the data signal DATA corresponding to the afterimage reference pattern as being an afterimage-vulnerable data signal. In such an embodiment of the present inventive concept, the afterimage-vulnerable data signal is a data signal of the data signal DATA input to the timing controller 300 that corresponds to the afterimage reference pattern.

The control signal output circuit 330 outputs a gamma reference voltage control signal GMACS for increasing or decreasing the gamma reference voltage GMA according to, for example, a variable data voltage (ΔVd in FIG. 6B) on a frame-by-frame basis in accordance with the afterimage vulnerable data signal.

For example, in a first frame, the control signal output circuit 330 does not output the Gamma Reference Voltage Control Signal (GMACS). In a second frame, the control signal output circuit 330 outputs a GMACS for increasing the gamma reference voltage GMA in accordance with the afterimage vulnerable data signal. In a third frame, the control signal output circuit 330 outputs a gamma reference voltage control signal GMACS for decreasing the gamma reference voltage GMA in accordance with the afterimage vulnerable data signal. For example, the gamma reference voltage control signal GMACS may have different values on a frame-by-frame basis.

With reference to FIG. 1, the power unit 400 generates voltages utilized for the display panel 100 by increasing or decreasing the driving power VCC input through the system. To this end, the power unit 400 may include, for example, an output switching element for switching an output voltage of an output terminal thereof, and, for example, a pulse width modulator PWM for increasing or decreasing the output voltage by controlling a duty ratio or a frequency of a control signal input to a control terminal of the output switching element. Herein, a pulse frequency modulator PFM may be included in the power unit 400 in place of the pulse width modulator PWM described herein above. It is also possible that both the PFM and PWM could both be included in the power unit 400. The pulse width modulator PWM may increase the duty ratio of the aforementioned control signal to increase the output voltage of the power unit 400 or decrease the duty ratio of the control signal to lower the output voltage of the power unit 400. The pulse frequency modulator PFM may increase the frequency of the aforementioned control signal to increase the output voltage of the power unit 400 or decrease the frequency of the control signal to lower the output voltage of the power unit 400. The output voltage of the power unit 400 may include, for example, a reference voltage VDD of about 6 [V] or more, a gamma reference voltage GMA of less than level 10, a common voltage in a range of about 2.5 [V] to about 3.3 [V], a gate high voltage of about 15 [V] or more and a gate low voltage of about −4 [V] or less. A person of ordinary skill in the art understands and appreciates that the inventive concept is not limited the values of the power unit 400 as described herein above.

The gamma reference voltage GMA is a voltage generated by voltage division of the reference voltage. In addition, the reference voltage and the gamma reference voltage GMA are analog gamma voltages, and they are applied to the data driver 220. The common voltage Vcom is provided to the common electrode of the display panel 100 through the data driver 220. The gate high voltage is a relatively high logic voltage of the gate signal, which is set to be a threshold voltage of the TFT or more. The gate low voltage is a relatively low logic voltage of the gate signal, which is set to be an off voltage of the TFT. The gate high voltage and the gate low voltage are applied to the gate driver 210.

Still referring to FIG. 1, the power unit 400 according to an embodiment of the inventive concept includes a gamma reference voltage adjuster 410. The gamma reference voltage adjuster 410 receives the gamma reference voltage control signal GMACS output from the timing controller 300 and increases or decreases the gamma reference voltage GMA by a variable data voltage (ΔVd of FIG. 6B) on a frame-by-frame basis. For example, in the case where the gamma reference voltage control signal GMACS is not input from the timing controller 300, the gamma reference voltage adjuster 410 does not adjust the gamma reference voltage GMA. In the case where the gamma reference voltage control signal GMACS for increasing the gamma reference voltage GMA is input from the timing controller 300, the gamma reference voltage adjuster 410 increases the gamma reference voltage GMA by the variable data voltage (ΔVd of FIG. 6B). On the other hand, in the case where the gamma reference voltage control signal GMACS for decreasing the gamma reference voltage GMA is input from the timing controller 300, the gamma reference voltage adjuster 410 decreases the gamma reference voltage GMA by the variable data voltage (ΔVd of FIG. 6B). In such an embodiment of the inventive concept, the gamma reference voltage control signal GMACS may have different values on a frame-by-frame basis as described above, although the gamma reference voltage GMA represents a substantially same gray level, and the voltage value may vary for each frame and the difference may correspond to the variable data voltage (ΔVd of FIG. 6B). The variable data voltage (ΔVd of FIG. 6B) has a fine voltage range less than a gamma reference voltage difference of about a gray level 1.

The gate driver 210 generates gate signals according to the gate control signal GCS provided from the timing controller 300 and sequentially applies the gate signals to the plurality of gate lines GL1 to GLi. In turn, the gate signals are provided to the TFT of the pixels in a horizontal line. The gate driver 210 may include, for example, a shift register that shifts a gate start pulse according to a gate shift clock to generate gate signals. The shift register may include a plurality of driving switching elements. The driving switching elements may be formed in a non-display area of the display panel 100. The driving switching elements may be formed in a substantially the same or a similar process as a switching element of the pixel.

The data driver 220 receives the data signals DATA' (e.g. image data) and the data control signal DCS from the timing controller 300. The data driver 220 samples the data signals DATA' according to the data control signal DCS. The data driver 220 latches the sampling data signals corresponding to one horizontal line in each horizontal period and applies the latched image data signals to the data lines DL1 to DLj. For example, the data driver 220 may perform digital to analog conversion of the data signals DATA' received from the timing controller 300. The conversion of the digital data signals into analog data signals may be performed by using the gamma reference voltages GMA input from the power unit 400, and the analog image data signals are applied to the data lines DL1 to DLj. Accordingly, although the data signal DATA received by the timing controller 300 represents a substantially same gray level being input, the gamma reference voltage GMA varies on a frame-by-frame basis, the data voltage varies on a frame-by-frame basis, and the voltage applied to the pixels R, G and B also varies on a frame-by-frame basis.

The timing controller 300 according to an embodiment may determine the afterimage vulnerable data signal of the data signal DATA representing the afterimage reference pattern and outputs a gamma reference voltage control signal GMACS for increasing or decreasing the gamma reference voltage GMA in accordance with the afterimage vulnerable data signal on a frame-by-frame basis. In addition, according to an embodiment of the inventive concept, the power unit 400 increases or decreases the gamma reference voltage GMA by the variable data voltage (ΔVd of FIG. 6B) based on the gamma reference voltage control signal GMACS on a frame-by-frame basis.

Accordingly, although the data signal DATA representing a substantially same gray level is input, the magnitude of the data voltage applied to the pixels R, G and B varies on a frame-by-frame basis, and the voltage charged in the liquid crystal layer also varies on a frame-by-frame basis. Thus, the method and apparatus of the inventive concept may reduce the afterimage due to the afterimage reference pattern. For example, scattering afterimage defects of LCD panels having different residual DC values, which may occur due to scattering of the manufacturing process, may be reduced or eliminated.

Figure 4:
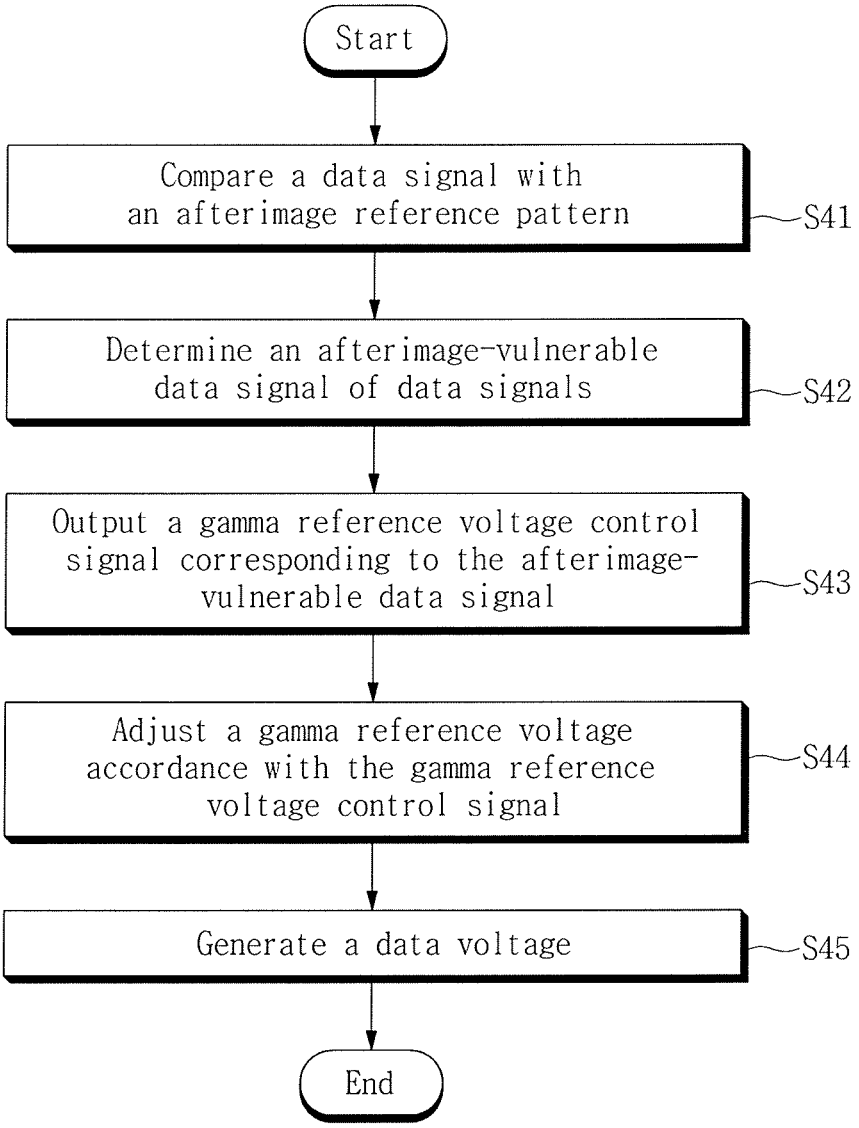
FIG. 4 is a flowchart illustrating a driving of an LCD device according to an embodiment of the inventive concept.
Figure 5:
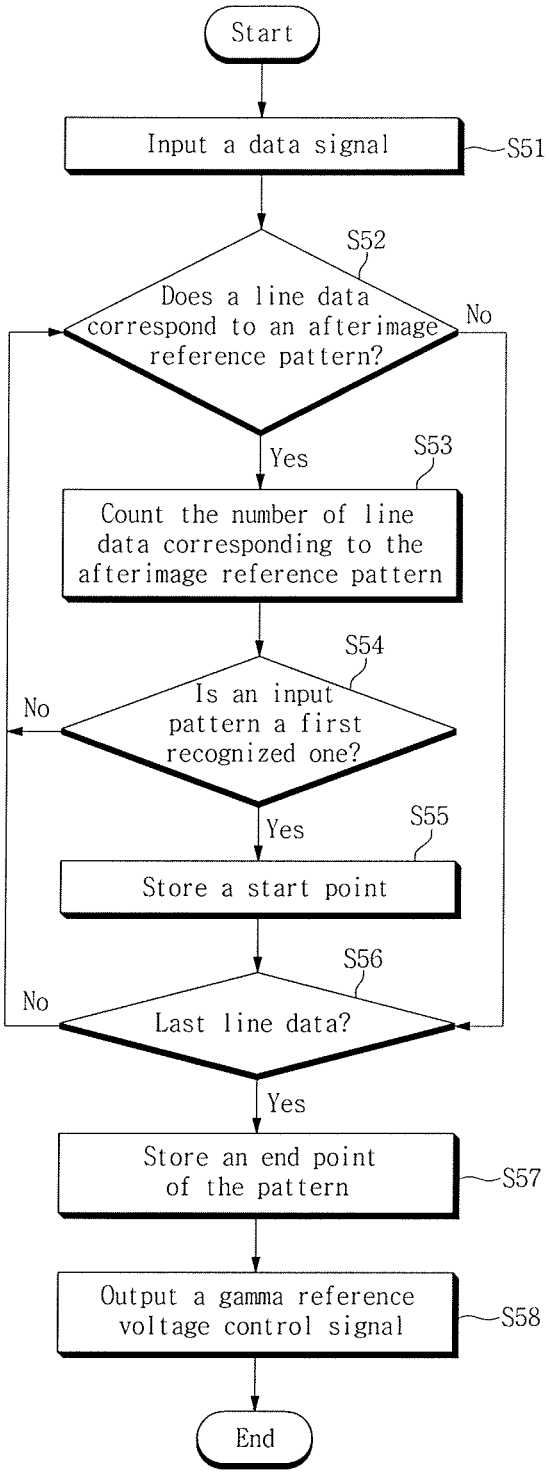
FIG. 5 is a flowchart illustrating an operation of a timing controller according to an embodiment of the inventive concept.
Figure 6A:
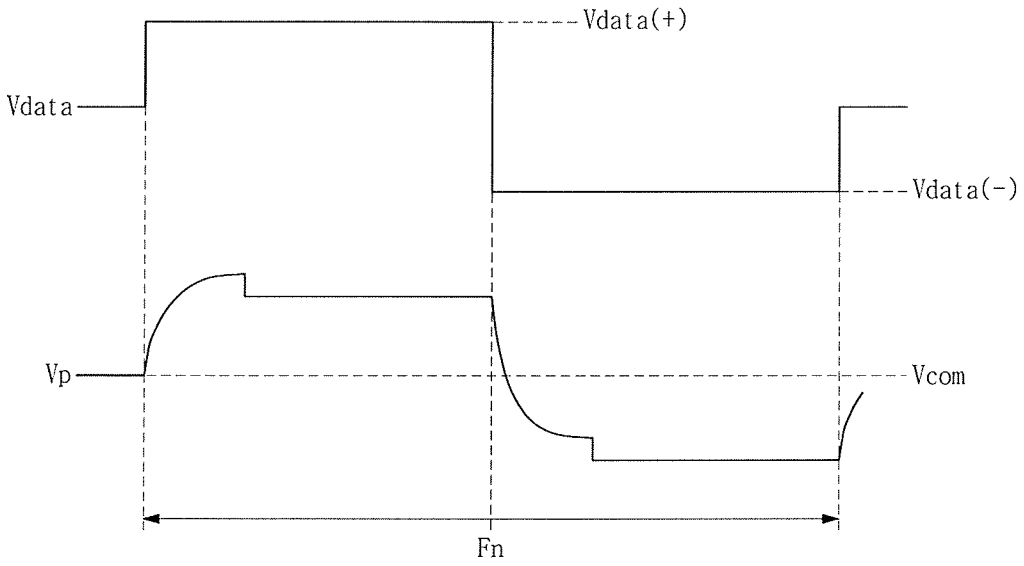
FIGS. 6A, 6B and 6C are views respectively illustrating a data voltage, a pixel voltage and a common voltage according to an embodiment of the inventive concept.
Figure 6B:
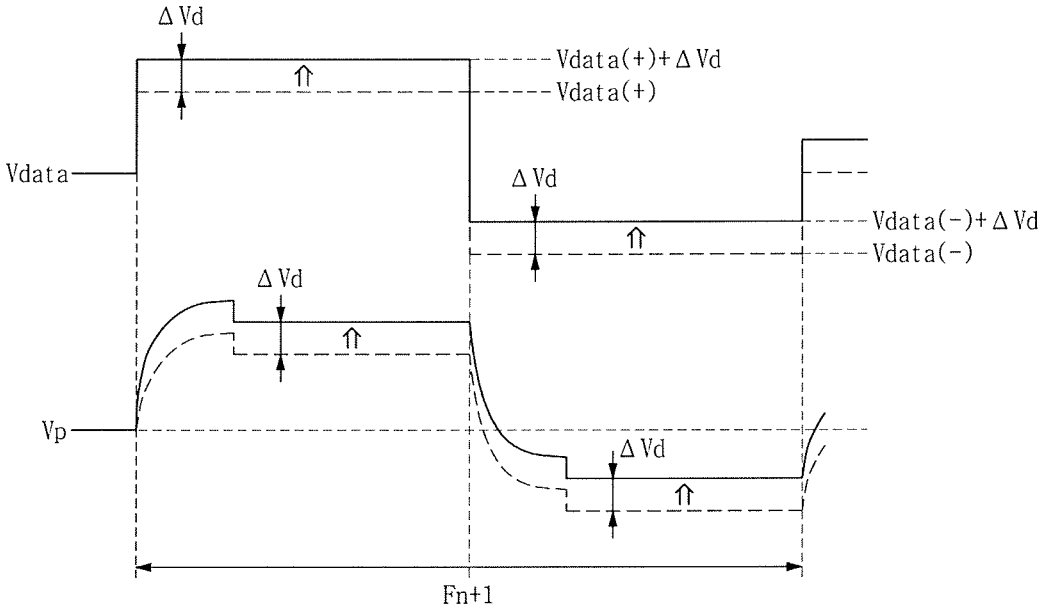
Figure 6C:
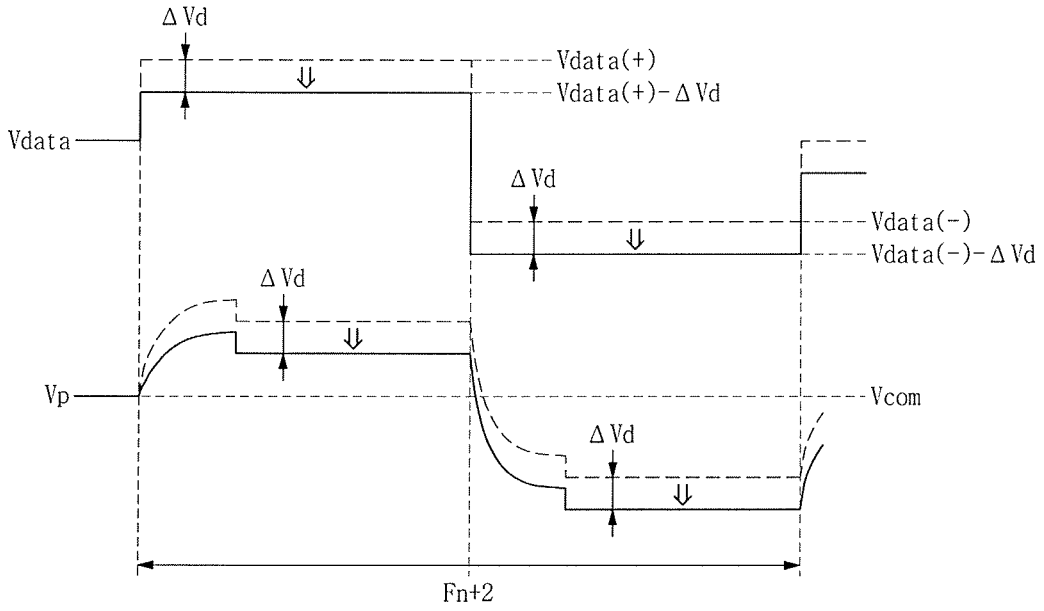

FIG. 4 is a flowchart illustrating driving of an LCD device according to an embodiment, FIG. 5 is a flowchart illustrating an operation of a timing controller 300 according to an embodiment, and FIGS. 6A, 6B and 6C are views respectively illustrating a data voltage, a pixel voltage and a common voltage according to an embodiment of the inventive concept.

Hereinafter, a method of driving an LCD device according to an embodiment will be described in detail with reference to FIGS. 4, 5, 6A, 6B and 6C.

Referring now to FIG. 4, at operation (S41) a data signal DATA is compared with an afterimage reference pattern. The input data signal DATA includes a plurality of frame data signals, and the frame data signal includes a plurality of line data signals. The input data signal DATA may be compared with the afterimage reference pattern on units of line data. The analyzer circuit 310 of the timing controller 300 may perform the comparing of the data signal DATA with at least one afterimage reference pattern, One or more afterimage reference patterns may be stored in a memory.

The afterimage reference pattern includes at least one predetermined pattern that is vulnerable to afterimage. For example, a pattern of white and black may be vulnerable to afterimage.

Subsequently, at operation (S42), an afterimage vulnerable data signal of the data signal DATA is determined as being present based on the comparison with the afterimage reference pattern. The data signal corresponding to the above-described afterimage reference pattern is determined as the afterimage-vulnerable data signal. The determinator circuit 320 may determine that the input signal DATA is an afterimage-vulnerable data signal. For example, the determinator circuit 320 may make such a determination on the favorability of the comparison performed with the afterimage reference pattern.

Next, at operation (S43), a gamma reference voltage control signal GMACS is output corresponding to the afterimage vulnerable data signal. The gamma reference voltage control signal GMACS is a signal for increasing or decreasing a gamma reference voltage GMA by a variable data voltage (ΔVd of FIG. 6B) on a frame-by-frame basis. The control signal output circuit 330, for example, will output the GMACS having variable data voltage on a frame-by-frame basis.

At operation (S44), the gamma reference voltage GMA is adjusted in accordance with the gamma reference voltage control signal GMACS. For example, gamma reference voltage controller (which in the example in FIG. 4 is part of the power unit 400) may receive the GMACS and adjust the gamma reference voltage GMA. For example, based on the input gamma reference voltage control signal GMACS, the gamma reference voltage GMA is increased or decreased by the variable data voltage (ΔVd of FIG. 6B) on a frame-by-frame basis.

At operation (S45), the data voltage is generated using the gamma reference voltage GMA.

Details of the above will now be described herein below with reference to FIGS. 5, 6A, 6B and 6C.

Referring to FIG. 5, at operation (S51), the data signal DATA is input to the timing controller 300 on a frame-by-frame basis. Hereinafter, a data signal DATA for one frame is referred to as a frame data signal. The frame data signal includes a plurality of line data signals. The line data signals may be data signals applied to pixels R, G and B connected to one gate line (e.g. one of GL1 to GLi).

At operation (S52), it is determined whether an i-th line data signal corresponds to the afterimage reference pattern. In an embodiment of the inventive concept, the afterimage reference pattern includes at least one reference pattern vulnerable to an afterimage. For example, the display of a pattern of white and black may be vulnerable to displaying an afterimage.

At operation (S53), in response to determining in operation (S52) that the i-th line data signal corresponds to the afterimage reference pattern, the number of succeeding line data signals, after the i-th line data signal, corresponding to the afterimage reference pattern, is counted.

On the other hand, in the case where in operation (S52) it is determined that the i-th line data signal does not correspond to the afterimage reference pattern, then at operation (S56) it is identified whether the i-th line data signal is a last line data signal of the frame data.

After operation (S53), at operation (S54) it is determined whether an input pattern of the i-th line data signal is a first recognized one of continuous line data signals having a substantially same afterimage reference pattern.

At operation (S55), in the case where at operation (S54) the input pattern of the i-th line data signal is the first one recognized among continuous line data signals having a substantially same afterimage reference pattern, then the i-th line data signal is stored as a start point of the afterimage vulnerable data signal. On the other hand, in the case where at operation (S54) the input pattern of the i-th line data signal is not the first recognized one of the line data signals having a substantially same afterimage reference pattern, it is identified whether the i-th line data signal is a last line data signal of the frame data signal.

In operation (S56), in the case where the i-th line data signal is a last line data signal of the frame data signal, then at operation (S57) the i-th line data signal is stored as an end point of a last afterimage vulnerable data signal. On the other hand, in the case where the i-th line data signal is not the last line data signal of the frame data signal, the process will again perform operation (S52) and proceed with the operations to determine a new afterimage vulnerable data signal.

Finally, at operation (S58), the gamma reference voltage control signal GMACS is output in accordance with the afterimage vulnerable data signal.

Referring to FIGS. 6A, 6B and 6C, it is shown that the gamma reference voltage GMA increases or decreases on a frame-by-frame basis in accordance with the gamma reference voltage control signal having different values on a frame-by-frame basis. Accordingly, the data voltage corresponding to the data signal representing a pattern vulnerable to an afterimage is adjusted on a frame-by-frame basis. For example, the gamma reference voltage GMA increases or decreases in accordance with the gamma reference voltage control signal GMACS having different values on a frame-by-frame basis, such that the data voltage Vdata corresponding to the afterimage vulnerable data signal increases or decreases by the variable data voltage (ΔVd) on a frame-by-frame basis.

Referring to FIG. 6A, during an n-th frame Fn, the gamma reference voltage control signal GMACS is not output and the gamma reference voltage GMA is not adjusted. In other words, the gamma reference voltage control signal is output only when it is determined that an afterimage-vulnerable data signal has been received by the timing controller. Accordingly, a positive data voltage Vdata (+) and a negative data voltage Vdata (−) are sequentially applied to the data line. A pixel voltage Vp is applied to the pixel R, G and B by the voltage applied to the data line, and the liquid crystal layer is charged by a voltage difference between the pixel voltage Vp and a common voltage Vcom.

Referring to FIG. 6B, during an (n+1)-th frame Fn+1, the gamma reference voltage control signal GMACS is output to increase the gamma reference voltage GMA in accordance with the afterimage-vulnerable data signal, and the gamma reference voltage GMA increases by the variable data voltage (ΔVd). Accordingly, in FIG. 6B both a positive polarity data voltage Vdata (+) and a negative polarity data voltage Vdata (−) increase by the variable data voltage (ΔVd). For example, a positive data voltage Vdata (+)+ΔVd increased from the positive data voltage Vdata (+) by the variable data voltage (ΔVd) and a negative data voltage Vdata(−)+ΔVd increased from the negative data voltage Vdata (−) by the variable data voltage (ΔVd) are alternately applied to the data line. Accordingly, a voltage difference between the pixel voltage Vp and the common electrode Vcom increases due to the increased positive polarity data voltage Vdata (+)+ΔVd to increase the voltage charged in the liquid crystal layer, and a voltage difference between the pixel voltage Vp and the common electrode Vcom decreases due to the increased negative polarity data voltage Vdata(−)+ΔVd to decrease the voltage charged in the liquid crystal layer.

Referring now to FIG. 6C, during an (n+2)-th frame Fn+2, the gamma reference voltage control signal GMACS is output to decrease the gamma reference voltage GMA in accordance with the afterimage vulnerable data signal, and the gamma reference voltage GMA decreases by the variable data voltage (ΔVd). Accordingly, a positive polarity data voltage Vdata (+) and a negative polarity data voltage Vdata (−) decrease by the variable data voltage (ΔVd). For example, a positive data voltage Vdata(+)-ΔVd decreased from the positive data voltage Vdata (+) by the variable data voltage (ΔVd) and a negative data voltage Vdata(−)-ΔVd decreased from the negative data voltage Vdata (−) by the variable data voltage (ΔVd) are alternately applied to the data line. Accordingly, a voltage difference between the pixel voltage Vp and the common electrode Vcom decreases due to the decreased positive polarity data voltage Vdata (+)-ΔVd to decrease the voltage charged in the liquid crystal layer, and a voltage difference between the pixel voltage Vp and the common electrode Vcom increases due to the decreased negative polarity data voltage Vdata(−)-ΔVd to increase the voltage charged in the liquid crystal layer.

Although the positive polarity data voltage Vdata (+) and the negative polarity data voltage Vdata (−) are depicted in the drawings to be alternately driven once, embodiments of the inventive concept are not limited thereto and the positive polarity data voltage Vdata (+) and the negative data voltage Vdata (−) may be alternately driven several times.

The variable data voltage (ΔVd) has a fine voltage range less than a gamma reference voltage difference of about a gray level 1. Accordingly, there is substantially no difference in luminance due to the fluctuation of the data voltage, and no flickering may occur.

According to an embodiment of the inventive concept, the afterimage-vulnerable data signal of the data signal DATA representing the afterimage reference pattern is determined and the gamma reference voltage control signal GMACS for increasing or decreasing the gamma reference voltage GMA on a frame-by-frame basis in accordance with the afterimage vulnerable data signal is output. The gamma reference voltage GMA increases or decreases by the variable data voltage (ΔVd) on a frame-by-frame basis based on the gamma reference voltage control signal GMACS.

As set forth hereinabove, the LCD device and the method of driving the LCD device may provide the following effects.

Although the data signal DATA having a substantially same gray level is input, the magnitude of the data voltage applied to the pixel R, G and B changes on a frame-by-frame basis such that the voltage charged in the liquid crystal layer changes on a frame-by-frame basis to reduce or eliminate the afterimage due to the afterimage reference pattern. In particular, scattering afterimage defects of the LCD panel having different residual DC values, which occur due to scattering of the manufacturing process, may be enhanced.

While the present inventive concept has been illustrated and described with reference to the embodiments thereof, a person of ordinary skill in the art should understand and appreciate that various changes in form and detail may be made thereto without departing from the spirit and scope of the present inventive concept.

What is claimed is:

1. A liquid crystal display device comprising:

a liquid crystal display panel comprising a gate line, a data line intersecting the gate line and a pixel connected to the gate line and the data line;

a timing controller configured to receive a data signal comprising a plurality of frames and output a data signal;

a power supply configured to generate a gamma reference voltage corresponding to the data signal; and a data driver configured to receive the data signal from the timing controller, receive the gamma reference voltage corresponding to the data signal from the power supply, and apply a data voltage to the data line, wherein the timing controller comprises:

an analyzer circuit configured to compare the data signal with an afterimage reference pattern;

a determinator circuit configured to determine an afterimage-vulnerable data signal of the data signal based on a correspondence of the data signal with the afterimage reference pattern compared by the analyzer circuit; and a control signal output circuit configured to output a gamma reference voltage control signal that controls an increase and a decrease of a gamma reference voltage by a variable data voltage on a frame-by-frame basis in accordance with the afterimage-vulnerable data signal, wherein the power supply comprises a gamma reference voltage adjuster configured to receive the gamma reference voltage control signal and adjust the gamma reference voltage, and wherein the gamma reference voltage control signal is only output when the determinator circuit determines the afterimage-vulnerable data signal of the data signal, and wherein the afterimage reference pattern used to compare with the data signal is predetermined and the same for each of the plurality of frames.

2. The liquid crystal display device according to claim 1, wherein the control signal output circuit only outputs the gamma reference voltage control signal at frames other than an N-th (N being a natural number) frame when the determinator circuit determines the afterimage-vulnerable data signal of the data signal.

3. The liquid crystal display device according to claim 2, wherein the control signal output circuit outputs the gamma reference voltage control signal to control an increase of a gamma reference voltage corresponding to the afterimage-vulnerable data signal at an (N+1)-th (N being a natural number) frame.

4. The liquid crystal display device according to claim 3, wherein the control signal output circuit outputs the gamma reference voltage control signal to control a decrease in a gamma reference voltage corresponding to the afterimage-vulnerable data signal at an (N+2)-th (N being a natural number) frame.

5. The liquid crystal display device according to claim 1, wherein the variable data voltage is less than a gamma reference voltage difference of about a gray level 1.

6. The liquid crystal display device according to claim 1, wherein the afterimage reference pattern has a white color and a black color.

7. The liquid crystal display device according to claim 1, further comprising a memory that stores the afterimage reference pattern.

8. The liquid crystal display device according to claim 1, wherein the data signal includes a plurality of line data signals, wherein the determinator circuit is further configured to:

determine whether an i-th line data signal among the plurality of line data signals corresponds to the afterimage reference pattern, count a number of succeeding line data signals after the i-th line data signal that correspond to the afterimage reference pattern, and determine the afterimage-vulnerable data signal of the data signal based on the counting of the number of succeeding line data signals.

9. A method of driving a liquid crystal display device, the method comprising:

comparing a data signal comprising a plurality of frames with an afterimage reference pattern, wherein the data signal includes a plurality of line data signals;

determining whether an i-th line data signal among the plurality of line data signals corresponds to the afterimage reference pattern;

counting a number of succeeding line data signals after the i-th line data signal that correspond to the afterimage reference pattern;

determining an afterimage-vulnerable data signal of the data signal based on the counting of the number of succeeding line data signals;

outputting a gamma reference voltage control signal corresponding to the afterimage-vulnerable data signal;

adjusting a gamma reference voltage in accordance with the gamma reference voltage control signal; and generating a data voltage based on the adjusted gamma reference voltage, wherein the outputting of a signal for adjusting the gamma reference voltage corresponding to the afterimage-vulnerable data signal comprises outputting the gamma reference voltage control signal corresponding to the afterimage-vulnerable data at frames other than an N-th (N being a natural number) frame only when the determining the afterimage-vulnerable data signal of the data signal compares favorably with the afterimage reference pattern, wherein the outputting of a signal for adjusting the gamma reference voltage corresponding to the afterimage-vulnerable data signal comprises outputting a gamma reference voltage control signal for increasing the gamma reference voltage corresponding to a value of the afterimage-vulnerable data at an (N+1)-th frame, and wherein the outputting of a signal for adjusting the gamma reference voltage corresponding to the afterimage-vulnerable data signal comprises outputting a gamma reference voltage control signal for decreasing the gamma reference voltage corresponding to a value of the afterimage-vulnerable data at an (N+2)-th frame.

10. The method according to claim 9, wherein the adjusting of the gamma reference voltage in accordance with the gamma reference voltage control signal comprises:

increasing or decreasing the gamma reference voltage by a variable data voltage less than a gamma reference voltage difference of about a gray level 1.

11. The method according to claim 9, wherein the afterimage reference pattern has a white color and a black color.

12. The method according to claim 9, wherein the comparing of the data signal comprising a plurality of frames with the afterimage reference pattern comprises:

retrieving an afterimage reference pattern.

13. A liquid crystal device, comprising:

a liquid crystal display panel comprising a plurality of gate lines, a plurality of data lines intersecting the gate line and a plurality of pixels, each connected to one of the plurality of gate lines and one of the plurality of data lines;

a timing controller configured to receive a data signal comprising a plurality of frames and output a data signal, and configured to determine an afterimage-vulnerable data signal of the data signal based on a correspondence of the data signal with at least one afterimage reference pattern;

a power supply configured to generate a gamma reference voltage corresponding to the data signal;

a data driver configured to receive the data signal from the timing controller, receive the gamma reference voltage corresponding to the data signal from the power supply, and apply a data voltage to the data line; and a gate driver configured to generate gate signals according to a gate control signal (GCS) provided from the timing controller and sequentially applies the gate signals to the plurality of gate lines;

wherein a positive data voltage Vdata (+) and a negative data voltage Vdata (−) are sequentially applied to each of the plurality of data lines during one frame, and a pixel voltage is applied to the plurality of pixels connected to the data lines, and wherein a liquid crystal layer is charged by a voltage difference between the pixel voltage and a common voltage, and the voltage difference is adjusted in response to detection of a correspondence of the data signal with the at least one afterimage reference pattern on a frame-by-frame basis, and wherein the at least one afterimage reference pattern is predetermined and the same for each of the plurality of frames.

14. The liquid crystal device according to claim 13, further comprising a memory that stores a plurality of afterimage reference patterns including said at least one afterimage reference pattern.

15. The liquid crystal device according to claim 13, wherein the timing controller receives from a graphic controller a data signal, a horizontal synch (Hsync) signal, a vertical synch (Vsync) signal, a clock (DCLK) signal.

16. The liquid crystal display device according to claim 15, wherein the afterimage-vulnerable data signal of the data signal representing the at least one afterimage reference pattern is determined and a gamma reference voltage control signal increases or decreases the gamma reference voltage on a frame-by-frame basis in accordance with the afterimage-vulnerable data signal being output.

17. The liquid crystal device according to claim 13, wherein the data signal includes a plurality of line data signals, wherein the timing controller is further configured to:

determine whether an i-th line data signal among the plurality of line data signals corresponds to the at least one afterimage reference pattern, count a number of succeeding line data signals after the i-th line data signal that correspond to the at least one afterimage reference pattern, and determine the afterimage-vulnerable data signal of the data signal based on the counting of the number of succeeding line data signals.

18. The liquid crystal device according to claim 13, wherein the positive data voltage Vdata (+) is applied at the beginning of each frame.

19. A non-transitory computer readable medium comprising instructions that, when executed by a processor, perform a method of driving a liquid crystal display device, the method comprising:

comparing a data signal comprising a plurality of frames with an afterimage reference pattern;

determining an afterimage-vulnerable data signal of the data signal based on the comparing with the afterimage reference pattern;

outputting a gamma reference voltage control signal corresponding to the afterimage-vulnerable data signal;

adjusting the gamma reference voltage in accordance with the gamma reference voltage control signal;

generating a data voltage based on the adjusted gamma reference voltage; and sequentially applying a positive data voltage Vdata (+) and a negative data voltage Vdata (−) to each of a plurality of data lines during one frame, wherein the positive data voltage Vdata (+) is applied at the beginning of each frame.

* * * * *